United States Patent [19]

Kodama

[11] 4,191,142

[45] Mar. 4, 1980

[54] SELF-CONTAINED HYDRAULIC LASH ADJUSTER

[75] Inventor: Hisashi Kodama, Toyota, Japan

[73] Assignee: Aisin Seiki Kabushiki Kaisha, Kariya, Japan

[21] Appl. No.: 880,519

[22] Filed: Feb. 23, 1978

[30] Foreign Application Priority Data

Mar. 2, 1977 [JP] Japan ..... 52/22926

[51] Int. Cl.[2] ..... F01L 1/24

[52] U.S. Cl. ..... 123/90.58; 123/90.55

[58] Field of Search ..... 123/90.48, 90.52, 90.53, 123/90.55, 90.58; 74/569

[56] References Cited

U.S. PATENT DOCUMENTS

| | | | |
|---|---|---|---|
| 1,062,580 | 5/1913 | Bollee | 123/90.58 |
| 2,109,459 | 3/1938 | Best | 123/90.55 |
| 2,109,815 | 3/1938 | Best | 123/90.58 |
| 2,833,257 | 5/1958 | Lengnick | 123/90.58 |
| 3,495,577 | 2/1970 | Collins | 123/90.58 |
| 3,521,608 | 7/1970 | Scheibe | 123/90.58 |
| 3,670,707 | 6/1972 | Guido | 123/90.58 |

*Primary Examiner*—Charles J. Myhre
*Assistant Examiner*—Jeffrey L. Yates
*Attorney, Agent, or Firm*—Sughrue, Rothwell, Mion, Zinn and Macpeak

[57] ABSTRACT

A self-contained hydraulic lash adjuster, which does not depend upon any external source of hydraulic fluid in operation, is used in the valve trains of internal combustion engines in order to take up the lash or operating clearance in the valve trains. The lash adjuster comprises a cylinder member, a plunger member slidably fitted therein, said cylinder and plunger members defining a fluid pressure chamber between each end wall thereof, said plunger member forming a reservoir chamber therewithin, and an elastic bag member disposed within the reservoir chamber, the inner wall surface of said elastic bag member being normally in communication with atmospheric pressure while the outer wall surface thereof being normally in contact with the fluid in the reservoir chamber.

3 Claims, 5 Drawing Figures

SELF-CONTAINED HYDRAULIC LASH ADJUSTER

BACKGROUND OF THE INVENTION

1. Field of the Invention

This invention relates to hydraulic lash adjusters used in the valve trains of internal combustion engines and the like, and more particularly to hydraulic lash adjusters of the self-contained type in which the fluid is sealed within the assembly with no provision for its replenishment from any external source during operation.

2. Description of the Prior Art

In the valve trains of internal combustion engines a predetermined valve clearance is generally provided in order to compensate for thermal expansion of various parts in the valve trains. However, since excess lash may be generated due to the valve clearance in the valve trains during engine operation, hydraulic lash adjuster have been used for automatically taking up the valve clearance in the valve trains, thereby preventing the possible lash and stabilizing the opening and closing operation of an engine intake or exhaust valve.

Conventional hydraulic lash adjusters compensate for fluid leakage by means of supplying pressurized fluid to the interior of the lash adjusters through a passageway in the cylinder block. However, there have been disadvantages that the passageway through which pressurized fluid flows is complicated in construction, and that the operation comes to be unstable due to changes in viscosity of pressurized fluid. In order to eliminate such disadvantages hydraulic lash adjusters of the self-contained type are being provided, which are not fed from an external source of hydraulic fluid but rather contain their own source of such fluid.

In the conventional hydraulic lash adjuster of the self-contained type, however, there have been still various drawbacks that the mechanism compensating for the fluid leakage is imperfect, that the operation comes to be unstable due to the entrapment of air in the fluid, and that the mechanism of the lash adjuster is quite complicated and expensive to manufacture.

SUMMARY OF THE INVENTION

It is a principal object of the invention to provide an improved hydraulic lash adjuster of the self-contained type which is not fed from an external source of hydraulic fluid and will overcome the conventional difficulties as mentioned above.

It is another object of the invention to provide a self-contained hydraulic lash adjuster which has an elastic bag member disposed in the reservoir chamber in order to surely compensate for changes in the fluid volume in the reservoir chamber in operation. The inner wall surface of the elastic bag member is normally in communication with atmospheric pressure, while the outer wall surface thereof is normally in contact with the fluid in the reservoir chamber.

It is further object of the invention to provide a self-contained hydraulic lash adjuster which is simple in construction and inexpensive to manufacture.

BRIEF DESCRIPTION OF THE DRAWINGS

These and other objects of the invention will be apparent from the following description of a preferred embodiment, having referance to the drawings wherein.

DESCRIPTION OF THE PREFERRED EMBODIMENT

Figure 1:
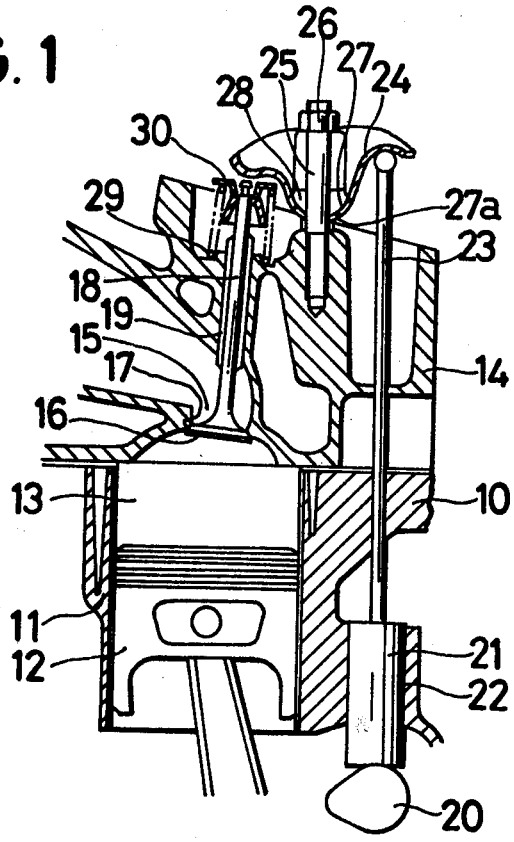
FIG. 1 is a transverse sectional view through a portion of an internal combustion engine having a valve operating train incorporating a hydraulic lash adjuster constructed in accordance with the present invention.
Figure 3:
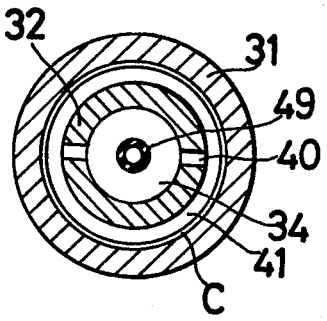
FIG. 3 is a sectional view through the lash adjuster, taken on the line III—III of FIG. 2.

Referring now in detail to the drawings, there is shown in FIG. 1 an engine cylinder block 10 in which is located a working cylinder 11 having a piston 12. Suitably secured to the top of the cylinder block 10 and forming a combustion chamber 13 above the piston 12 is a cylinder head 14 having a cylinder head port 15 whose communication with the combustion chamber 13 is controlled by a poppet valve 16 cooperating with a seat 17 thereof in the closed position. The valve 16 has a stem portion 18 slidably mounted for reciprocation in a guide member 19 inserted in the cylinder head 14. In conventional manner, the reciprocal movement of the valve 16 is effected by rotation of a cam 20 being suitably driven by the engine in timed relation with the movement of the piston 12. A hydraulic lash adjuster 21 of the present invention is in the eternal abutment on the cam 20 and is slidably supported for reciprocation in a adjuster bore 22 formed in the cylinder block 10. The upward movement of the lash adjuster 21 is transmitted by a push rod 23 to a rocker arm 24 to actuate the valve 16. The rocker arm 24 is rockably mounted on the cylinder head 14 by a suitable stud or post 25 and nut 26, one end of which is in abutment on the stem 18 of the valve 16 and the other end of which is in abutment on the push rod 23. The rocker arm 24 has a bottom wall spherically depressed to form a bearing surface 27 which slidably embraces the stud 25 and rocks on a bearing member 28 fixed beneath the nut 26. The bearing surface 27 is provided with an aperture **27*a* through which the stud 25 passes, to permit the rocking movement of the rocker arm 24. A valve return spring 29 is positioned between a spring retainer 30 fixed on the stem 18 and the cylinder head 14, and serves to maintain the valve 16 normally in the closed position as illustrated in FIG. 1**.

Figure 2:
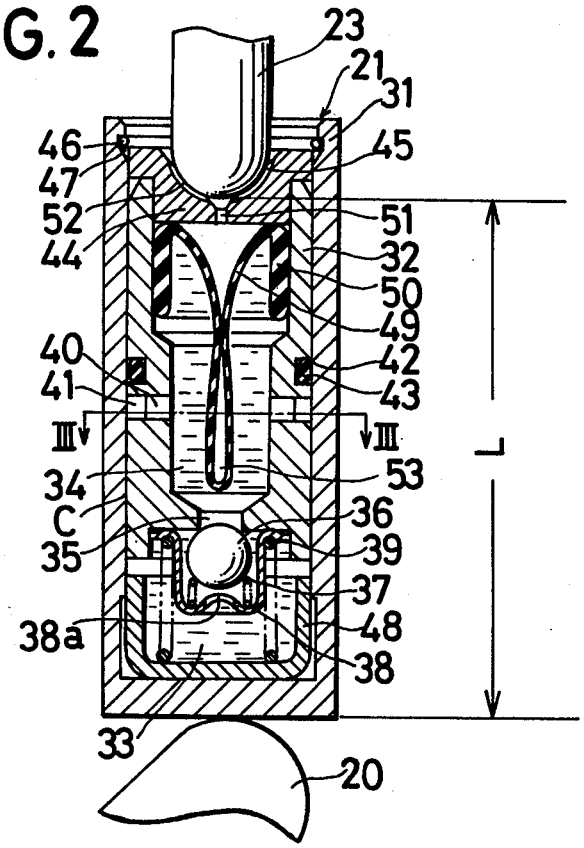
FIG. 2 is an enlarged longitudinal sectional view through the lash adjuster of FIG. 1, showing its internal parts in detail.

As shown in FIG. 2, the lash adjuster 21 comprises a generally cup-shaped cylinder member 31 and a plunger member 32 slidably fitted therein. Between the closed end of the cylinder member 31 and the bottom wall of the plunger member 32 is a fluid pressure chamber 33 which is normally filled with a predetermined quantity of hydraulic fluid such as lubricating oil. The plunger member 32 is hollow, forming a reservoir chamber 34 therewithin which is connected with the pressure chamber 33 through a passage 35 provided on the bottom wall of the plunger member 32. A check valve in the form of a ball 36 is retained in the pressure chamber 33 to close the passage 35 by a spring 37 within a cup-shaped cage member 38 so that when released fluid may flow with a relatively rapid rate into the pressure chamber 33 from the reservoir chamber 34, but not in the reverse direction. The end wall of the cage member 38 is provided with apertures **38*a* which establish the normal communication between the interior of the cage member 38 and the exterior thereof. The numeral 39 indicates a plunger return spring which biases the plunger member 32 upward of the cylinder member 31 and serves also to maintain the cage 38 seated against the lower end of the plunger member 32. The spring 39 is stronger than the spring 37. The side walls of the plunger member 32 are provided with two apertures 40 in communication with an annular groove 41 thereof. A slight clearance C exists between the slidably fitted external side surfaces of the plunger member 32 and the internal side surfaces of the cylinder member 31, through which clearance a leakage of hydraulic fluid from the pressure chamber 33 will be conducted with a relatively slow rate of fluid flow during each lift stroke of the cam 20 while the check valve 36 is closed against flow through the passage 35. This leakage or leack down fluid is collected in the groove 41 and enters the reservoir chamber 34 through each aperture 40. The plunger member 32 is provided with an outer peripheral groove 42 above the groove 41 in which an adjuster seal in the form of a synthetic rubber O-ring 43 is disposed for liquid-tight seal in engagement with the internal surface of the cylinder member 31. Closing the open upper end of the plunger member 32 is a push rod seat member 44 which has a concave push rod seat 45 in the upper surface thereof to receive the convex lower end of the push rod 23. The thrust of the plunger member 32 is transmitted to the push rod 23 through the push rod seat member 44. An upper limit stop, in the form of a split snap ring 46 engaging an internal groove 47 in the cylinder member 31 above the push rod seat member 44, is provided for limiting the upward movement of the plunger member 32 and for retaining the lash adjuster in assembly. A lower limit stop, in the form of a cup 48 fixed to the lower side walls of the cylinder member 31, is provided for limiting the downward movement of the plunger member 32 and for mounting the plunger return spring 39** thereon.

Figure 4:
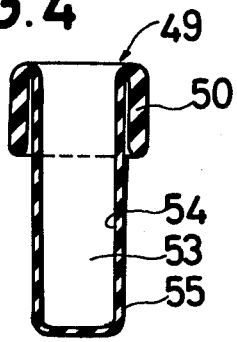
FIG. 4 is a longitudinal sectional view of an elastic bag member of FIG. 2 in a disassembled condition.
Figure 5:
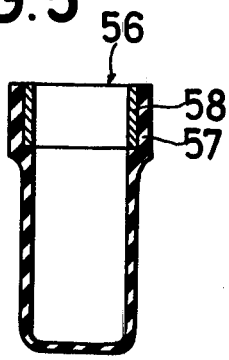
FIG. 5 is a view similar to FIG. 4 but showing a modified embodiment thereof.

Within the upper portion of the reservoir chamber 34 is mounted an elastic synthetic rubber bag member 49 which is of generally tubular and bottom closed shape in a disassembled condition as shown in FIG. 4. The bag member 49 has a thick sealing flange 50 secured to the internal surfaces of the plunger member 32 for fluid-tight sealing engagement therewith. The open upper end of the bag member 49 is covered with the push rod seat member 44 having a central hole 51 which extends therethrough and is in communication with slots 52 in the push rod seat 45 for connection to atmospheric pressure. An interior 53 of the bag member 49 or an inner wall surface 54 thereof is normally in communication with atmospheric pressure through the central hole 51 and the slots 52. An outer wall surface 55 of the bag member 49 is normally in contact with the fluid in the reservoir chamber 34. Since the bag member 49 is of elasticity, the volume of the interior 53 of the bag member 49 may be varied in response to variation in the fluid volume in the reservoir chamber 34. FIG. 5 shows a modified embodiment of the elastic bag member 49. A bag member 56 has a flange 57 in which a metal ring 58 is securely fitted, to thereby assure the sealing thereof.

In the operation of the lash adjuster mechanism, each lifting movement of the cylinder member 31 in response to rotation of the cam 20 is transmitted to the plunger member 32 through the medium of the hydraulic fluid which is trapped within the pressure chamber 33. The upward movement of the plunger member 32 is transmitted to the push rod 23 through the push rod seat member 44. As a result, the rocker arm 24 rocks on the bearing member 28 and opens the engine valve 16 against the valve return spring 29. The spring 29 serves both to maintain the valve 16 normally in the closed position thereof and to return the lash asjuster 21 to the initial position thereof after each lift stroke of the cam 20. Accordingly, since the load of the valve return spring 29 increases and the fluid pressure in the pressure chamber 33 increases, the check valve 36 moves to the seated position thereof at lower end of the passage 35. At this time, a slight leakage of fluid from the pressure chamber 33 enters the reservoir chamber 34 through the leak clearance C, the annular groove 41 and the apertures 40, and the plunger member 32 is lowered in the cylinder member 31, thereby shortening the axial length L between the push rod seat 45 and the lower surface of the cylinder member 31.

When the cam 20 is lowered after completion of each lift stroke thereof, the cylinder member 31 moves downwardly. As a result, the load of the valve return spring 29 on the push rod seat member 44 decreases, and the spring 29 serves to permit the valve 16 to close. Since the volume of the pressure chamber 33 is increased by the action of the plunger return spring 39, the fluid pressure in the pressure chamber 33 decreases. This decrease of the fluid pressure permits the check valve 36 to release from the seat. Then the sufficient fluid flows to the pressure chamber 33 through the passage 35 to compensate for the leakage through the clearance C, thereby returning the axial length L to the initial length. At the start of the subsequent lift stroke the fluid pressure in the pressure chamber 33 again increases, causing the check valve 36 to be again seated and the similar operating cycle to be repeated.

The axial length L of the lash adjuster assembly 21 may be accidentally varied also in response to changes in viscosity resistance of the hydraulic fluid which well depend upon temperature. However, it is to be noted that the hydraulic fluid which is used in the lash adjuster 21 is normally a silicone oil or silicone fluid whose viscosity resistance is almost uniform from the low temperatures to the high temperatures.

When there should be produced the lash or a clearance between the upper end of the valve stem 18 and the cam 20 due to any wear or thermal contraction of the various parts in the valve train, the plunger return spring 39 urges the plunger member 32 and the cylinder member 31 out of the cylinder member 31 and against the operating face of the cam 20, respectively, thereby lengthening the axial length L of the lash adjuster and compensating for the wear or the thermal contraction of the parts in the valve train. On the other hand, when thermal expansion in the valve train occurs, for instance, due to heating of the engiue, a certain amount of fluid leakage from the pressure chamber 33 enters the reservoir chamber 34 through the slight clearance C, thereby shortening the axial length L.

Filling of the lash adjuster 21 with fluid is accomplished by assembling the parts which are being submerged in the fluid so as to prevent the air from entering the cylinder member 31. After assembling no further addition of fluid is required of during the life of the lash adjuster 21. Thus a self-contained hydraulic lash adjuster is obtained, which does not depend upon any external source of fluid in operation.

As previously described, the elastic bag member 49 is mounted within the upper portion of the reservoir chamber 34, the interior 53 or the inner wall surface 54 of which is normally in communication with atmospheric pressure, and the outer wall surface 55 of which is normally in contact with the fluid in the reservoir chamber 34. As a result, changes in the fluid volume in the reservoir chamber 34 in operation are compensated for by the elasticity of the bag member 49. If the leakage of the fluid from the adjuster seal 43 should be occurred, the bag member 49 may compensate for such objectionable leakage due to the elasticity thereof, so that the pressure acting on the adjuster seal 43 is lowered, thereby reducing the thrust resistance of the plunger member 32. Similarly, changes in the volume of the fluid in the lash adjuster assembly 21 in response to temperatures are compensated for by the elasticity of bag member 49.

It is appreciated that various minor changes in the construction and arrangement of the parts may be made without departing from the spirit and scope of the invention as defined in the following claims.

I claim:

1. A self-contained hydraulic lash adjuster comprising a cylinder member having an end wall closing the lower end thereof, a hollow plunger member having an upper open end and a lower end wall slidable axially in said cylinder member, said plunger and cylinder members defining a pressure chamber between each end wall thereof, said hollow plunger member having a reservoir chamber therein, a push rod seat member engaging said upper end of said plunger member for closing said reservoir chamber and for transmitting the thrust of said plunger member to a push rod, said push rod seat member being provided with a central hole, means for allowing a relatively slow rate of fluid flow from said pressure chamber to said reservoir chamber, a check valve for allowing a relatively rapid rate of fluid flow only from said reservoir chamber to said pressure chamber through a passage provided in the end wall of said plunger member, an elastomeric bag member having a generally tubular shape with a closed bottom end and an open upper end, said open upper end being fixed to the inner wall of said plunger member and said closed bottom end being freely disposed in said reservoir chamber, the interior of said bag member being normally disposed in communication with atmospheric pressure through said central hole in said push rod seat member and the outer surface of said bag member being in fluid tight contact with said reservoir chamber.

2. A self-contained hydraulic lash adjuster according to claim 1, wherein said elastomeric bag member has a sealing flange disposed in fluid tight engagement with the internal surface of said plunger member.

3. A self-contained hydraulic lash adjuster according to claim 2, further comprising a metal ring disposed within said flange for pressing said flange radially outwardly into fluid tight engagement with said plunger member.

* * * * *